US005863478A

United States Patent [19]

Rüf et al.

[11] Patent Number: 5,863,478

[45] Date of Patent: Jan. 26, 1999

[54] PROCESS FOR THE MANUFACTURE OF CELLULOSE FIBRES

[75] Inventors: Hartmut Rüf, Vöcklabruck; Christoph Schrempf, Bad Schallerbach, both of Austria

[73] Assignee: Lenzing Aktiengesellschaft, Lenzing, Austria

[21] Appl. No.: 930,132

[22] PCT Filed: Mar. 3, 1997

[86] PCT No.: PCT/AT97/00041

§ 371 Date: Oct. 30, 1997

§ 102(e) Date: Oct. 30, 1997

[87] PCT Pub. No.: WO97/33020

PCT Pub. Date: Sep. 12, 1997

[30] Foreign Application Priority Data

Mar. 4, 1996 [AT] Austria ..... 407/96

[51] Int. Cl.[6] ..... D01F 2/02

[52] U.S. Cl. ..... 264/151; 264/187; 264/210.2; 264/210.7; 264/210.8; 264/211.12; 264/233

[58] Field of Search ..... 264/151, 187, 264/203, 210.2, 210.8, 211.12, 233, 210.7

[56] References Cited

U.S. PATENT DOCUMENTS

| | | | |
|---|---|---|---|
| 4,246,221 | 1/1981 | McCorsley, III | 264/203 |
| 5,417,909 | 5/1995 | Michels et al. | 264/203 X |
| 5,543,101 | 8/1996 | Ruf | 264/187 |

FOREIGN PATENT DOCUMENTS

| | | |
|---|---|---|
| 494851 | 7/1992 | European Pat. Off. . |
| 574870 | 12/1993 | European Pat. Off. . |
| 4219658 | 12/1993 | Germany . |
| 9207124 | 4/1992 | WIPO . |
| 9214871 | 9/1992 | WIPO . |
| WO 94/27903 | 12/1994 | WIPO . |
| WO 96/07779 | 3/1996 | WIPO . |
| WO 96/18760 | 6/1996 | WIPO . |

OTHER PUBLICATIONS

Michels et al., Lenzinger Berichte 9/94, pp. 57–60 (Sep. 1994).

Weigel et al. Lenzinger Berichte 9/94, pp. 31–36 (Jun. 1994).

Mortimer, S.A. and Peguy, A., "72 Spinning of Fibres through the N–methylmorpholine–N–oxide process," published in Cellulose and cellulose derivatives: Physicochemical aspects and industrial applications edited by J.F. Kennedy et al., pp. 561–567. (1993).

*Primary Examiner*—Leo B. Tentoni

*Attorney, Agent, or Firm*—Baker & Botts LLP

[57] ABSTRACT

The invention is concerned with a process for the production of cellulose fibers wherein a solution of cellulose in a tertiary amine-oxide is extruded through spinning holes of a spinneret, whereby filaments are extruded, the extruded filaments are conducted across an air gap, a precipitation bath and a drawing device whereby the filaments are drawn, the drawn filaments are further processed into cellulose fibers, the drawn filaments being exposed during further processing to a tensile stress in longitudinal direction not exceeding 5.5 cN/tex.

7 Claims, No Drawings

PROCESS FOR THE MANUFACTURE OF CELLULOSE FIBRES

INTRODUCTION

The present invention is concerned with a process for the production of cellulose fibres. In this process, a solution of cellulose in a tertiary amine-oxide is extruded through spinning holes of a spinneret, whereby filaments are extruded, the extruded filaments are conducted across an air gap, a precipitation bath and a drawing device whereby the filaments are drawn, and the drawn filaments are further processed into cellulose fibres.

BACKGROUND OF THE INVENTION

As an alternative to the viscose process, in recent years there has been described a number of processes wherein cellulose, without forming a derivative, is dissolved in an organic solvent, a combination of an organic solvent and an inorganic salt, or in aqueous saline solutions. Cellulose fibres made from such solutions have received by BISFA (The International Bureau for the Standardisation of man made Fibres) the generic name Lyocell. As Lyocell, BISFA defines a cellulose fibre obtained by a spinning process from an organic solvent. By "organic solvent", BISFA understands a mixture of an organic chemical and water. "solvent-spinning" means dissolving and spinning without derivatisation.

So far, however, only one process for the production of a cellulose fibre of the Lyocell type has achieved industrial-scale realization. In this process N-methylmorpholine-N-oxide (NMMO) is used as a solvent. Such a process is described e.g. in U.S. Pat. No. 4,246,221 and provides fibres having a high tensile strength, a high wet-modulus and a high loop strength.

However, the usefulness of plane fibre assemblies such as fabrics produced from the above fibres is significantly restricted by the pronounced tendency of the fibres to fibrillate when wet. Fibrillation means breaking off of the wet fibre in longitudinal direction at mechanical stress, so that the fibre gets hairy, furry. A fabric made from these fibres and dyed significantly loses colour intensity as it is washed several times. Additionally, light stripes are formed at abrasion and crease edges. The reason for fibrillation may be that the fibres consist of fibrils arranged in fibre direction, and that there is only little crosslinking between these.

WO 92/14871 describes a process for the production of a fibre having a reduced tendency to fibrillation. This is achieved by providing all the baths with which the fibre is contacted before the first drying with a maximum pH value of 8.5.

WO 92/07124 also describes a process for the production of a fibre having a reduced tendency to fibrillation, according to which the never dried fibre is treated with a cationic polymer. As such a polymer, a polymer having imidazole and azetidine groups is indicated. Additionally, a treatment with an emulsifiable polymer, such as polyethylene or polyvinylacetate, or a crosslinking with glyoxal may be carried out.

In the lecture "Spinning of fibres through the N-methylmorpholine-N-oxide process", held by S. A. Mortimer and A. Peguy at the CELLUCON conference 1993 in Lund, Sweden, published in "Cellulose and cellulose derivatives: Physico-chemical aspects and industrial applications" edited by J. F. Kennedy, G. O. Phillips and P-O. Williams, Woodhead Publishing Ltd., Cambridge, England, pp. 561–567, it was mentioned that the tendency to fibrillation rises as drawing is increased.

From the lecture "Besonderheiten des im TITK entwickelten Aminoxidprozesses" held by Ch. Michels, R. Maron and E. Taeger at the symposium "Alternative Cellulose—Herstellen, Verformen, Eigenschaften" at Rudolstadt, Germany, in September 1994, published in Lenzinger Berichte September, 1994, pp. 57–60, it is known that there is a relation between the filament tension in the air gap and the mechanical properties of the fibrous materials. At the same symposium, P. Weigel, J. Gensrich and H.-P. Fink mentioned in their lecture "Strukturbildung von Cellulosefasern aus Aminoxidlösungen", published in Lenzinger Berichte September, 1984, pp. 31–36, that the fibre properties may be improved when the filaments are dried without simultaneously exposing them to a tensile stress.

In DE-A-42 19 658 and EP-A-0 574 870 it is described that post-drawing of the precipitated filaments has a negative effect on the textile properties of the fibres, particularly on their elongation.

From WO 96/18760 cellulose filaments are known which exhibit a strength of 50 to 80 cN/tex, a breaking elongation of 6 to 25% and a specific tear time of at least 300 s/tex. During production these filaments are exposed to a tension in the range of 5 to 93 cN/tex. It is disclosed that these fibres exhibit a low tendency to fibrillation.

SUMMARY OF THE INVENTION

It has been shown that the known cellulose fibres of the Lyocell type are insufficient regarding their fibre properties and their tendency to fibrillation, and thus it particularly is the object of the present invention to provide a process whereby fibres having improved properties may be produced, wherein the so-called working capacity, i.e. the mathematical product from fibre strength (conditioned) and elongation (conditioned) is improved.

In a process for the production of cellulose fibres, this objective is attained by combining the steps of

- extruding a solution of cellulose in a tertiary amine-oxide through spinning holes of a spinneret, whereby filaments are extruded,
- conducting the extruded filaments across an air gap, a precipitation bath and a drawing device whereby the filaments are drawn,
- further processing the drawn filaments into cellulose fibres, and
- exposing the drawn filaments while being further processed to a tensile stress in longitudinal direction not exceeding 5.5 cN/tex.

DETAILED DESCRIPTION OF THE INVENTION

It has been shown that good fibre properties may be achieved in an easy way by carrying out further processing of the drawn filaments such as washing out the tertiary amine-oxide from the filament and post-treatment (finishing), as well as particularly the transportation of the filaments while they are further processed, applying as little tension as possible, i.e. a tensile stress which should not exceed 5.5 cN/tex, to the filaments.

For the purposes of the present invention, the term "further processing" comprises all the steps carried out on the filaments, including transportation of the filaments, after they have passed the first take up point of the drawing device.

Conveniently, the drawn filaments are cut while being further processed and subsequently washed.

Moreover, it has been shown that the length of the distance whereover the filaments are conducted from the spinneret to the drawing device has an effect on the fibre properties insofar as the fibre properties are the better the shorter this distance is. A preferred embodiment of the process according to the invention consists in that the length of this distance does not exceed 12 m and in particular does not exceed 1 m.

The invention is further concerned with a process for the production of cellulose fibres characterized by the combination of steps of extruding a solution of cellulose in a tertiary amine-oxide through spinning holes of a spinneret, whereby filaments are extruded, conducting the extruded filaments across an air gap, a precipitation bath and a drawing device whereby the filaments are drawn, further processing the drawn filaments into dried cellulose fibres, the length of the distance whereover the filaments are conducted from the spinneret to the drawing device not exceeding 12 m and in particular not exceeding 1 m.

Moreover, it has proven convenient to conduct the drawn filaments while being further processed and before an optionally provided cutting step across several godets provided subsequently to each other, the rate of each godet being lower than that of the godet provided immediately before it.

All known cellulose dopes may be processed according to the process according to the invention. Thus, these dopes may contain of from 5 to 25% of cellulose. Cellulose contents of from 10 to 18%, however, are preferred. As raw material for the production of pulp, hard or soft wood may be employed, and the polymerisation degree of the pulp(s) may be within the range of the usual commercially available technical products. It has been shown however that when the molecular weight of the pulp is higher, the spinning behaviour will be better. The spinning temperature may range of from 75° to 140° C., depending on the polymerisation degree of the pulp and the solution concentration respectively, and may be optimized for each pulp or for each concentration in a simple way.

In the following, the test procedures and preferred embodiments of the invention will be described in more detail.

Fibrillation Evaluation

The friction of the wet fibres during washing or finishing processes was simulated by the following test: 8 fibres were put in a 20 ml sample bottle with 4 ml of water and were shaken for 9 hours in a laboratory shaker of the RO-10 type made by the company Gerhardt, Bonn (Germany), at stage 12.

Afterwards, the fibrillation behaviour of the fibres was evaluated under the microscope by counting the number of fibrils per 0.276 mm of fibre length.

Textile Data

Strength and elongation conditioned were analyzed according to the BISFA rule "Internationally agreed methods for testing viscose, modal, cupro, lyocell, acetat and triacetate staple fibres and tows", edition 1993.

Loop Strength and Elongation (Conditioned) Test

The loop strength was tested by forming a loop with two fibres and subjecting this loop to a tensile strength test. To determine the average, only those fibres which broke at the loop were considered.

To measure the loop strength and elongation, a vibroscope, i.e. a titre measuring apparatus of the Lenzing AG type for the non-destructive titre determination according to the vibration method and a vibrodyn, i.e. an apparatus for tensile strength tests at single fibres at a constant deformation rate were employed.

As the standard reference atmosphere, air of 20° C. and a relative humidity of 65% was employed.

EXAMPLE 1

A 15% spinning solution of sulphite and sulphate pulp (9% of water, 76% of NMMO) having a temperature of 125° C. was spun using a spinneret comprising 100 spinning holes with a diameter of 100 $\mu$m each. The output of dope was 0.017 g/hole per minute. The titre of each of the filaments was 1.9 dtex.

The filaments were conducted across an air gap into the precipitation bath and over a godet whereby a tension was exerted on the filaments, which thus were drawn in the air gap. After passing the godet, the filaments were immediately cut and only afterwards further processed by washing out the amine-oxide, avivage and drying. Thus, the further processing of the filaments was without tension. The textile data of the fibres obtained are shown in Table 1.

EXAMPLE 2

(Comparative Example)

The procedure was analogous to that of Example 1, except that the filaments were not cut immediately after passing the godet, i.e. the first take up point, but conducted towards a further godet located at a distance of 2.2 meters from the first godet. The rate of the second godet was adjusted such that the filament cable between the first and the second godet was exposed to a tension of 11.6 cN/tex.

After passing the second godet, the filaments were immediately cut and only afterwards further processed by washing out the amine-oxide, avivage and drying. Thus the further processing of the filaments after the first take up point was not without tension. The textile data of the fibres obtained are shown in Table 1.

TABLE 1

| | Example 1 | Example 2 |
|---|---|---|
| Tension on the cable (cN/tex) | 0 | 11.6 |
| Strength cond. (cN/tex) | 37.5 | 34.3 |
| Elongation cond. (%) | 15.0 | 10.8 |
| Loop strength (cN/tex) | 20.9 | 18.8 |
| Loop elongation (%) | 5.8 | 4.1 |
| Fibrils | 14 | 29 |
| working capacity | 562 | 370 |

In the row "fibrils", the average number of fibrils on a fibre length of 276 $\mu$m is indicated. The working capacity is the mathematical product from strength (cond.) and elongation (cond.).

From Table 1 it can be seen that further processing of the fibres without tension results in a product having improved properties. Among these properties, above all the lower number of fibrils and the higher working capacity should be pointed out.

EXAMPLE 3

A dope having the composition of Example 1 was extruded at 120° through a spinneret having 1 spinning hole with a diameter of 100 μm, producing filaments having a single fibre titre of 1.8 dtex. On the filaments produced, the effect of a drawing stress on the tendency to fibrillation was analyzed by exposing the filaments to different weights, varying also the exposure duration. The results are shown in Table 2.

TABLE 2

| Test no. | Stress (cN/tex) | Time (s) | Number of fibrils |
|---|---|---|---|
| A | 2.2 | 10 | 1 |
| B | 2.2 | 600 | 4 |
| C | 5.6 | 10 | 3 |
| D | 5.6 | 600 | 8.9 |
| E | 10.9 | 10 | 7 |
| F | 10.9 | 600 | 12 |

The Tests no. E and F are Comparative Tests. From Table 2 it can be seen that the tendency to fibrillation is the more pronounced the higher the stress is and the longer it acts upon the filament.

EXAMPLE 4

The procedure employed was analogous to that of Example 1, except that the distance from the spinneret to the godet was varied. The results are shown in Table 3.

TABLE 3

| | Test 1 | Test 2 | Test 3 |
|---|---|---|---|
| Distance spinneret/godet (m) | 12 | 25 | 48 |
| Titre (dtex) | 1.30 | 1.39 | 1.29 |
| Strength cond. (cN/tex) | 34.8 | 32.7 | 34.5 |
| Elongation cond. (%) | 11.8 | 11.6 | 11.1 |
| Fibrils | 38 | 38 | 41 |
| working capacity | 403 | 379 | 383 |

From the results of Table 3 it can be seen that the length of the distance whereover the filaments are conducted to the drawing devise (godet) has an influence on the working capacity of the fibre insofar as the working capacity significantly declines when the distance exceeds 12 m.

We claim:

1. A process for the production of cellulose fibres comprising the steps of:

extruding a solution of cellulose in a tertiary amine-oxide through one or more spinning holes of a spinneret, whereby filaments are extruded, conducting said filaments across a distance from the spinneret across an air gap into a precipitation bath by a drawing device, whereby filaments are drawn, and forming cellulose fibers from the drawn filaments while exposing the drawn filaments to a tensile stress in longitudinal direction not exceeding 5.5 cN/tex.

2. A process according to claim 1 further comprising the steps of cutting the drawn filaments prior to forming said cellulose fibres and washing the cellulose fibres.

3. A process according to claim 1 or claim 2, wherein the length of the distance whereover said filaments are conducted from said spinneret to said drawing device does not exceed 12 m.

4. A process according to claim 3 wherein the length of the distance whereover said filaments are conducted from said spinneret to said drawing device does not exceed 1 m.

5. A process for the production of cellulose fibres comprising the steps of:

extruding a solution of cellulose in a tertiary amine-oxide through spinning holes of a spinneret, whereby filaments are extruded, conducting said filaments across a distance from said spinneret across an air gap into a precipitation bath by a first drawing device, subsequently conducting the drawn filaments to at least one other drawing device which has a drawing rate which is lower than the prior drawing device whereby said filaments are drawn, and forming dried cellulose fibers from the drawn filaments wherein the length of the distance whereover said filaments are conducted from said spinneret to said first drawing device does not exceed 12 m.

6. A process according to claim 5 wherein the length of the distance whereover said filaments are conducted from said spinneret to said first drawing device does not exceed 1 m.

7. A process according to claim 1 wherein the drawing device includes a first drawing device and at least one other drawing device in series which has a drawing rate which is lower than the prior drawing device.

* * * * *